United States Patent [19]

Adams, Jr.

[11] 4,188,207

[45] Feb. 12, 1980

[54] ALUMINUM PRODUCTION

[76] Inventor: Clyde M. Adams, Jr., 3509 Biddle St., Cincinnati, Ohio 45220

[21] Appl. No.: 953,561

[22] Filed: Oct. 23, 1978

[51] Int. Cl.[2] ..... C22B 21/00
[52] U.S. Cl. ..... 75/68 B
[58] Field of Search ..... 75/68 R, 68 AB

[56] References Cited

U.S. PATENT DOCUMENTS

| | | | |
|---|---|---|---|
| 2,184,705 | 12/1939 | Willmore | 75/68 A |
| 2,206,562 | 7/1940 | Gentil | 75/68 A |

*Primary Examiner*—M. J. Andrews
*Attorney, Agent, or Firm*—James E. Anderson

[57] ABSTRACT

A process for separating and refining substantially pure aluminum from aluminum-bearing materials including bauxites, clays and metallic scrap, wherein a mixture of such aluminum-bearing materials, calcium chloride and a reducing agent is heated above 1600° C., and gases are vented to a cooling zone where condensed chlorides and aluminum are collected. Condensed aluminum trichloride is recycled and mixed with lime to produce calcium chloride in another starting batch. The reducing agent preferably is a carbon or silicon compound.

10 Claims, No Drawings

ALUMINUM PRODUCTION

BACKGROUND OF THE INVENTION

1. Field of the Invention

The separation of substantially pure metallic aluminum from minerals, oxides and impure metal by chemical methods which employ the combined actions of such reducing agents as carbon and silicon together with relatively nonvolatile, stable halides.

2. Description of the Prior Art

Direct reduction of aluminum from minerals or mixtures containing oxides or silicates of aluminum has been the subject of many investigations, publications and patents. The Cowles patents (e.g., U.S. Pat. No. 324,659) issued in the 1800's, taught a workable scheme, (practiced before the Hall-Heroult electrolysis became dominant) based on the reaction:

$$Al_2O_3+3C \rightarrow 2Al+3CO \quad (1)$$

This reaction is very endothermic and, like all endothermic reactions, is favored by high temperature. Cowles used the electrical resistance of mixed solid reagents to develop temperatures in excess of 1800° C. Many variations of what has come to be called "carbothermic" reduction were reduced to practice, but not necessarily commercialized. Difficulties included: (a) a tendency to form aluminum carbide; and (b) a tendency for back-reaction. The products of the reaction upon cooling can form the oxide, carbide and/or oxycarbide of aluminum, which are losses of metallic product aluminum. Cowles met these problems by incorporating copper or copper-oxide in the charge, thus producing an aluminum-copper alloy. In fact, many methods, including some quite recent, contemplate reduction to an alloy, followed by separate extraction of pur aluminum. For example (see Schmidt U.S. Pat. No. 3,254,988 and Wood U.S. Pat. No. 3,758,289) carbothermic reduction can lead to an alloy containing silicon and iron.

Silicon (in the form of ferrosilicon) has been proposed (see Schmidt U.S. Pat. No. 3,655,362) as a reducing agent to supplement or supplant carbon:

$$2Al_2O_3+3Si \rightarrow 4Al+3SiO_2 \quad (2)$$

Advantages include: (a) aluminum and silicon here form no compounds; and (b) there is little tendency for back-reaction.

The main disadvantage of Reaction (2) is that it does not go to completion, and the aluminum-silicon alloy produced must be further processed if the objective is to secure pure aluminum.

Despite formidable technical obstacles, pursuit of direct reduction, ongoing for over a century, with yet no substantive commercial realization, continues to receive much attention, primarily because: (a) there is the compelling prospect of drastically reducing the energy consumed in producing aluminum; (b) low grade ores and byproducts may become viable sources of aluminum, without first extracting pure $Al_2O_3$; and (c) direct reduction producing impure metal appears less of a deterrent with the possible emergence of halide refining.

Direct reduction can be coupled with halide separation in various ways: In general, the halogen elements (flourine, chlorine, bromine and iodine) find application in non-electrolytic thermochemical separation and refining, because (a) many halide compounds are volatile and so lend themselves to vapor phase separations of relatively non-volatile metals, and (b) some halide reactions, such as disproportionation condensation, are highly selective. The four halogens tend to behave similarly, but not identically. The fluorides and chlorides generally are more stable and have higher melting and boiling points than the bromides and iodides. Chlorine, the most abundant and least costly of the halogens, lends itself to aluminum separation and refining. However, in some schemes, fluorine or bromine offers specific advantages and cannot be ruled out. Cominations of halogens are always possible. But there are inevitable losses, and the overall view, from the standpoints both of economy and physical chemistry, is that the most likely reagents will be chlorides.

Pivotal to halide separation or refining is the disproportionation reaction:

$$3AlCl \rightleftharpoons AlCl_3+2Al \quad (3)$$

Reaction (3), as written, is exothermic and takes place upon cooling, and the reverse reaction is endothermic, upon heating. The monohalide (or subhalide) AlCl gas is stable only above about 1200° C., and "disproportionates" in accordance with Reaction (3) when cooled much below this temperature (assuming one atmosphere total pressure). $AlCl_3$(at lower temperatures, actually $Al_2Cl_6$) is a gas, and Al a liquid, at the disproportionation temperature. Pure, solid $AlCl_3$ sublimes at 180° C., and is soluble in water and many molten salts. Reaction (3) probably was recognized in the middle 1940's. (See Gross U.S. Pat. No. 2,470,305) It is highly selective. The usual object in separation or refining is somehow to produce AlCl at high temperature, deposit pure liquid Al by disproportionation, and recycle the $AlCl_3$.

Consider a simple hypothetical prior art arrangement for halide refining comprising a hot chamber, maintained well above 1200° C., and a "cold" chamber well below 1200° C. The chambers are connected by two gas conduits. Impure metallic aluminum is placed in the hot chamber; $AlCl_3$ gas arrives through one conduit from the cold chamber; reverse Reaction (3) takes place in the hot chamber: AlCl gas passes through the other conduit to the cold chamber where it disproportionates into pure product aluminum and $AlCl_3$; and $AlCl_3$ is recycled back to the hot chamber. Impure aluminum would be continuously fed to, and residue (mostly iron and silicon) withdrawn from, the hot chamber; pure product aluminum would be withdrawn from the cold chamber. Theoretcally, at least, there would be no net consumption of chlorine; chlorine carrying aluminum would simply be recycled in a closed loop. (See Phillips U.S. Pat. Nos. 3,217,820 and 3,249,424; McGeer U.S. Pat. No. 3,243,282; Southam U.S. Pat. No. 3,292,914; and Dewing U.S. Pat. No. 3,436,210).

The great difficulty with halide refining has reposed with the handling of active, aggressive, corrosive, environmentally offensive halide vapors at high temperature. Halide refining has been seriously considered as a second step following simple direct reduction by carbon or silicon; the first step produces an alloy and the second, pure aluminum. A potential alternative is halide separation, i.e., combined reduction and halide treatment. It has long been perceived that chloridizing (or halidizing) reagents could react directly with impure aluminum oxide in the presence of carbon to produce AlCl gas, and, by disproportionation, pure aluminum (See Sparwald U.S. Pat. No. 3,186,832; Othmer U.S. Pat. Nos. 3,793,003; 3,853,541; and 3,856,508).

Many direct or indirect halidizing agents have been proposed, including: $Cl_2$, HCl, $FeCl_2$, $SiCl_4$ and $AlCl_3$ (Significantly, all of these are gases at temperatures well below that required for monohalide formation). Many chemical equations can be conceived, but a few suffice to represent the above thinking. For example, at relatively low temperature, elemental chlorine attacks oxides in concert with carbon:

$$Al_2O_3+3Cl_2+3C \rightarrow 2AlCl_3+3CO \quad (4)$$

$$Fe_2O_3+2Cl_2+3C \rightarrow 2FeCl_2+3CO \quad (5)$$

Intermediate chlorides further attack aluminum oxide:

$$Al_2O_3+3FeCl_2+3C \rightarrow 2AlCl_3+3Fe+3CO \quad (6)$$

Aluminum trichloride reacts at higher temperature:

$$Al_2O_3+AlCl_3+3C \rightarrow 3AlCl+3CO \quad (7)$$

Without exception, arrangements set forth in issued patents or published literature inherently embody manipulation of hot gaseous halides, a very serious drawback. This is only one consequence of incorporating a relatively high chemical potential of halogen in the system, a signal defect of published methods. High halogen activity also leads to losses of halogen through formation and discard of stable halides of alkali and alkaline earth metals (mainly $CaCl_2$, $MgCl_2$, NaCl and KCl); also, traces of other halide vapors ($FeCl_2$ and $SiCl_4$) contaminate the aluminum (with Fe and Si). Finally, severe environmental pollution is to be expected from any process involving high halogen activity (including Hall-Heroult electrolysis, the current mainstay of the industry.)

In addition, as with non-halide direct reduction, back-reactions present difficulties. When the disproportionation Reaction (3) takes place in the presence of CO, some aluminum reacts to form oxide and oxycarbide. Rapid cooling of the AlCl gas has been found necessary to minimize back-reactions. These and other problems have proven severe enough to prevent commercialization of direct halide reduction.

An interesting and important variant of halide reduction has enjoyed some success: alumina is reacted with carbon and elemental chlorine to produce $AlCl_3$, which is then condensed, dissolved in a bath of molten salt (NaCl, LiCl and $AlCl_3$), and electrolyzed to produce elemental $Cl_2$ (thence recycled) and aluminum. At least one manifestation of the present invention takes advantage of and constitutes an improvement upon this developed technology.

SUMMARY OF THE INVENTION

This invention in a broad sense embraces the discovery that certain alkaline earth chlorides are so highly stable at high temperatures (of the order of 1500° to 2000° C.), that in the presence of a reducing agent they will react with only a few metallic elements, such as aluminum, and alkali metals in a highly selective manner, without forming chlorides with most other elements, and in particular with iron and silicon; this set of conditions forms an ideal environment for occurence of the disproportionation reaction without intervention of contaminating side reactions. More specifically, aluminum-bearing raw materials such as a mixture of bauxites, clay and industrial by-products containing oxidized and/or metallic aluminum, are combined and heated with a reducing agent and an alkaline earth chloride, which in the preferred embodiment comprises calcium chloride. During such heating, gases are vented, and thereafter upon cooling, condensed chlorides and pure aluminum are collected. Condensed chlorides preferrably are then recycled back into the batch of starting raw materials.

The main advantages of the present invention include the following:

(1) Low grade aluminum sources can be processed directly.
(2) Consumables are low cost.
(3) Substantially condensed (liquid and solid) reactants are used. Upon heating, these reactants emit a mixture of gases containing AlCl, from which pure aluminum is condensed by disproportionation.
(4) The aluminum sources may be metallic, non-metallic or a mixture thereof.
(5) The energy required, 4–5 KWL/Lb aluminum, is about half that for electrolytic reduction, 8–10 KWH/Lb.
(6) Aluminum of extraordinary purity is produced.
(7) Because relatively nonvolatile reactants are used, there is substantially no pollution.
(8) The process can be scaled to suit the need.
(9) With little loss in thermal efficiency the process can be stopped and started.

DESCRIPTION OF THE PREFERRED EMBODIMENTS

In accordance with the invention, the main realization is that a relatively stable chloride, principally $CaCl_2$, is an ideal chloridizing agent:

$$Al_2O_3+CaCl_2+Si \rightarrow 2AlCl+CaSiO_3 \quad (8)$$

$CaCl_2$ is a low-cost commercial chemical; it is used to melt ice on sidewalks and suppress dust on gravel roads (the latter by its deliquescent extraction of water from the air). At high temperature, $CaCl_2$ is distinguished from more active chlorides by its relatively high boiling point and much lower chlorine activity.

Reaction (8), strongly endothermic and thus favored by high temperature, proceeds at about 1750°–1800° C., which is below the boiling point of $CaCl_2$ (1870° C.). The gas mixture emerging from the hot reaction zone contains AlCl and unreacted $CaCl_2$. The $CaCl_2$ thus performs dual functions: (a) as a chloridizing reactant, and (b) as a diluent carrier gas. The $CaCl_2$ gas presents a benign environment for the disproportionation Reaction (3); aluminum and $CaCl_2$ do not react. Upon slow cooling of the gas mixture, two immiscible liquids simultaneously will condense, i.e., aluminum and $CaCl_2$, well above melting points of both substances; the liquid $CaCl_2$ floats on and protects the higher density liquid aluminum. The other product of disproportionation, $AlCl_3$, condenses at a much lower temperature or dissolves in the $CaCl_2$.

Since both $CaCl_2$ and $AlCl_3$ preferrably are to be recycled, and the discarded residue, a calcium silicate slag or solid, contains very little chlorine, this element is largely conserved. If the aluminiferous raw material contains sodium or potassium, there will be NaCl or KCl in the emergent gases; these condense with the $CaCl_2$, in which they are soluble.

Other stable chlorides might be considered as substitutes for $CaCl_2$ in Reaction (8). The chlorides of barium and strontium might work quite well, but, inasmuch as the cations stay with the residue, these reagents are considered too expensive. $MgCl_2$ boils at too low a temperature and cannot be dried. The chlorides of sodium, potassium and lithium are individually, too volatile and too stable. However, mixtures of some of these other chlorides with $CaCl_2$ could offer certain advantages.

Bromides and fluorides may function in Reaction (8), but are thought to offer no major advantages. Bromides are expensive and fluorides present handling and environmental problems. Iodides are thought to be too volatile and unstable.

$CaCl_2$ induces a chlorine activity much too low to form chlorides of many other metals, notably iron and silicon or even magnesium, so these elements will stay in the residue. On the other hand, NaCl and KCl may be formed, but, fortunately, they are far too stable to react with metallic aluminum. The overall chemical system is thus highly selective, yielding very pure aluminum.

The reducing agent shown in Reaction (8) is elemental silcon. Carbon could be used:

$$Al_2O_3+CaCl_2+2C\rightarrow CaO+2AlCl+2CO \quad (9)$$

Calcium chloride and reducing agent can also react with other forms of oxidized aluminum, such as dehydrated clay:

$$Al_2Si_2O_7+CaCl_2+2C\rightarrow 2AlCl+CaSiO_3+SiO_2+2CO \quad (9A)$$

$$Al_2Si_2O_7+CaCl_2+Si\rightarrow 2AlCl+CaSiO_3 2SiO_2 \quad (9B)$$

From Reactions (9) and (9A) the emergent gas is a mixture of AlCl, $CaCl_2$ and CO. There is hazard of partial back-reaction between CO and aluminum during disproportionation. In Reaction (8) no back-reaction is considered possible, because all oxide reaction products stay with the residue; the AlCl gas becomes physically separated from all oxides before disproportionation. This is important, because metallic aluminum at high temperature can react with most oxides.

Non carbonaceous reducing agents, which form condensed, substantially non-volatile oxides, in this sense, are preferred over carbon. These include silicon (actually ferrosilicon) and calcium silicide, $CaSi_2$, both articles of commerce and produced in tonnage quantities for the steel industry. However, carbon is the least costly reducing agent, especially in light of the fact that such sources as high-sulfur coal or coke can be accommodated by incorporating extra lime in the charge for desulfurization, and overall process economics will ultimately determine which reducing agent is preferred. (Moreover, the evaporant $CaCl_2$ dilutes the CO, impeding back reaction.)

Finally, the more powerful reducing agents, such as $CaSi_2$, have the effect of lowering the reaction temperature. This, in turn, reduces the quantity of $CaCl_2$ needed in the charge to function as a diluent carrier gas, a feature significant to overall process economics.

Actually, the ultimate reducing agent may always be carbon. Ferrosilicon is produced by carbon reduction of siliceous iron ore, and $CaSi_2$ by carbon reduction, simultaneously, of lime and silica sand:

$$FeSiO_3+3C\rightarrow FeSi+3CO \quad (10)$$

$$CaO+2SiO_2+5C\rightarrow CaSi_2+5CO \quad (11)$$

These processes consume energy, only a small part of which is recovered by combustion of the CO, usually in a waste-heat boiler. In effect, the purchase of ferrosilicon (which is available at up to 98 percent Si content) is tantamount to the purchase of energy, because Reaction (8) consumes less energy than Reaction (9). In this sense, CaSi is an even more potent energy source, in that Reaction (12), below, consumes less energy per pound of aluminum than does Reaction (8):

$$5Al_2O_3+5CaCl_2+2CaSi_2\rightarrow 3Ca_2SiO_4+CaSiO_3+10AlCl \quad (12)$$

Moreover, $CaSi_2$ is a more potent reducing agent than silicon and promotes formation of AlCl at a lower temperature. Close examination of overall costs and the behavior of the marketplace will determine whether an aluminum producer will manufacture its own ferrosilicon, $CaSi_2$, or both. The main point is, carbon may be used as an indirect rather than direct reducing agent to avoid adverse back-reactions.

Other strongly reducing metallic elements or ferroalloys can also be used, but ferrosilicon and/or $CaSi_2$ appear most economical.

Aluminum (impure, scrap, dross, etc.) can itself function as a low cost reducing agent:

$$Al_2O_3+3CaCl_2+4Al\rightarrow 6AlCl+3CaO \quad (13)$$

$$Al_2Si_2O_7+3CaCl_2+4Al\rightarrow Ca_2SiO_4+CaSiO_3+6AlCl \quad (9C)$$

Reactions (13) and (9C) are very important to the prospect of processing combined oxide and scrap.

The remaining major feature of the chemical methodology has to do with recycling the $AlCl_3$ byproduct of disproportionation. This is done by hydrolyzing the $AlCl_3$ and reacting with $Ca(OH)_2$ (lime):

$$2AlCl_3+3Ca(OH)_2+6H_2O\rightarrow 2Al(OH)_3+3CaCl_2.2H_2O \quad (14)$$

This may be viewed, somewhat simplistically, as a two-step sequence:

$$2AlCl_3+6H_2O\rightarrow 6HCl+2Al(OH)_3 \quad (14A)$$

$$6HCl+3Ca(OH)_2\rightarrow 3CaCl_2.2H_2O \quad (14B)$$

Pulverized limestone can be used instead of $Ca(OH)_2$ in Reactions (14) and (14B). The $CaCl_2$ then becomes a reactant at high temperature in, for example, Reaction (8), and the $Al(OH)_3$ is dehydrated, usually with carbon, at 800°-900° C.:

$$2Al(OH)_3+3C\rightarrow Al_2O_3+3CO+3H_2 \quad (15)$$

The $Al_2O_3$, also becomes a high temperature reactant. Other hydrates, such as kaolinite clay, can similarly be dehydrated with carbon:

$$H_4Al_2Si_2O_9+2C\rightarrow Al_2Si_2O_7+2CO+2H_2 \quad (16)$$

In summary, a wet charge of mixed insoluble solids and soluble salts is heated. At very low temperature, below 200° C., the hydrolysis of $AlCl_3$ and concomitant reaction with lime, Reaction (14), occurs. Then after excess water has been evaporated, chemically combined water is removed, with the help of carbon, at about 900° C. as in Reactions (15) and (16). Finally, AlCl forms in Reactions like (8), (12) and (13), near 1800° C., and this monohalide disproportionates upon cooling past about 1200° C. to give pure aluminum. $AlCl_3$ and/or excess $CaCl_2$ are recycled.

For continuous operation, those reactions taking place at or below 1000° C. can be implemented in a primary reactor, and those above 1000° C. in a secondary reactor. The gas mixture emerging from the first reactor contains $H_2O$, $H_2$, and CO, and, if limestone is used, $CO_2$; the gas mixture from the second reactor contains AlCl, $CaCl_2$ and CO. The hot condensed material emerging from the first reactor contains the aluminiferous raw material, the recycled $Al_2O_3$ (resulting from hydrolysis of $AlCl_3$ and dehydration of $Al(OH)_3$), $CaCl_2$, and reducing agent (which may be impure metallic aluminum); this hot material is transferred directly to the second reactor. The condensed material from the second reactor contains calcium oxide or silicate or a lime-silica slag, and, frequently, molten iron; whatever iron was present in the original charge is reduced to molten iron in the second reactor, and is usually similar in composition to blast furnace iron, containing appreciable concentrations of carbon and silicon.

The function of the water is to dissolve recycled $AlCl_3$, thereby facilitating reaction with lime. The chlorine is thus captured and retained as $CaCl_2$, and this reaction takes place in aqueous environment near or slightly above ambient temperature. Trying to accomplish this chlorine capture "dry" would present problems. For example, one could postulate a "dry" reaction:

$$2AlCl_3+3CaO \rightarrow Al_2O_3+3CaCl_2$$

This reaction should indeed procede as written, but not below 180° C., the sublimation temperature of $AlCl_3$. Consequently, this and other "dry" reactions require handling one of the reactants, $AlCl_3$, in gaseous form, presenting formidable corrosion and pollution hazards, which hazards this "wet" system circumvents. In other words, one good way to prevent escape or manipulation of $AlCl_3$ gas is to dissolve it in water. However, it may also be possible to do this with low melting anhydrous molten salts such as $NaAlCl_4$.

In an alternative practice of the invention, calcium chloride may be purchased as a low cost raw material instead of lime, mixed with the aluminiferous raw material and reducing agent, the mixture dehydrated by heating near 900° C., and finally heated to about 1800° C. to produce aluminum monochloride, and, ultimately, following disproportionation, aluminum trichloride, and metallic aluminum. The aluminum trichloride need not necessarily be recycled, but may be regarded a valuable end product to be sold or processed separately; for example, $AlCl_3$ can be hydrolyzed and calcined to produce HCl and high purity $Al_2O_3$, or electrolyzed in a molten salt bath containing NaCl, LiCl and $AlCl_3$ to produce $Cl_2$ and metallic aluminum. In this practice of the invention, all reactants and products are handled essentially "dry" except for water of hydration.

Examples will now serve to further illustrate the overall chemistry:

EXAMPLE I

Clay, carbon and lime are mixed with recycled aluminum trichloride and calcium chloride. The charge balance, expressed in moles, is:

| | |
|---|---|
| 2 | $AlCl_3$ |
| 2 | $H_4Al_2Si_2O_9$ |
| 3 | $Ca(OH)_2$ |
| 13 | C |
| 6 | $CaCl_2 . 2H_2O$ |
| more than 6 | $H_2O$ |

Upon heating, first the $AlCl_3$ hydrolyzes and reacts with $Ca(OH)_2$, (Reaction (14)); next, at higher temperature, near 900° C., the dehydration Reactions (15) and (16) take place; finally, at about 1800° C., $Al_2O_3$ and dehydrated clay react with carbon (Reactions (9) and (9A)) and the excess calcium chloride evaporates; the emerging hot gas is thus a mixture of AlCl, $CaCl_2$ and CO. When this gas mixture cools, the AlCl disproportionates (Reaction (3)) producing four moles of liquid aluminum; liquid calcium chloride condenses with the aluminum; the aluminum trichloride condenses at a much lower temperature and is recycled with the calcium chloride.

EXAMPLE II

Clay, silicon, carbon and lime are mixed with recycled aluminum trichloride and calcium chloride. The charge balance is:

| | |
|---|---|
| 2 | $AlCl_3$ |
| 2 | $H_4Al_2Si_2O_9$ |
| 3 | $Ca(OH)_2$ |
| 3 | Si |
| 3 | Si |
| 7 | C |
| 6 | $CaCl_2.2H_2O$ |
| more than 6 | $H_2O$ |

This differs from Example I only in that silicon is substituted for carbon as the high temperature reducing agent. Accordingly the aluminum monochloride forms by Reactions (8) and (9B). However, carbon is still used to act as a low temperature (below 1000° C.) reducing agent to assist the dehydration of aluminum hydroxide and clay.

When silicon is used as the high temperature reducing agent, there is no CO in the emerging hot gas, and thus no risk of adverse back reaction. The energy consumption is also less with silicon. These advantages must be weighed against the higher cost of silicon as compared to carbon in making final selection of a high temperature reducing agent. It is entirely practical to use a mixture of carbon and silicon.

As in Example I, aluminum trichloride and calcium chloride are recycled, and the charge shown produces four moles of metallic aluminum.

EXAMPLE III

Impure aluminum, carbon and lime are mixed with recycled aluminum trichloride and calcium chloride. The charge balance is:

| | |
|---|---|
| 2 | $AlCl_3$ |

-continued

| | |
|---|---|
| 4 | Al (impure) |
| 3 | $Ca(OH)_2$ |
| 3 | C |
| 6 | $CaCl_2 . 2H_2O$ |
| more than 6 | $H_2O$ |

The reactions below 1000° C. are the same as in Example I and II, except there is no clay to dehydrate. At about 1800° C. aluminum monochloride is produced by Reaction (13) and the emerging hot gas is roughly a 50:50 mixture of AlCl and $CaCl_2$ and no CO and no hazard of back reaction.

As before, $CaCl_2$ and $AlCl_3$ are recycled, and four moles of aluminum are produced.

EXAMPLE IV

Impure aluminum, clay, and carbon are mixed with calcium chloride; part of the $CaCl_2$ comes from recycling and the rest is introduced as a consumable raw material, $CaCl_2.2H_2O$. The charge balance is:

| | |
|---|---|
| 1 | $H_4Al_2Si_2O_9$ |
| 4 | Al |
| 2 | C |
| 3 | $CaCl_2 .2H_2O$ (raw material) |
| 6 | $CaCl_2$ |

Except for water of hydration in the clay and calcium chloride, the charge is essentially dry. Upon heating, the calcium chloride loses its water of crystallization below 400° C. and the clay is dehydrated near 900° C. (Reaction (16)). At about 1800° C. aluminum monochloride forms by Reaction (9C) and the emerging hot gas is about half AlCl and half $CaCl_2$; the latter is recycled. Disproportionation gives four moles of aluminum and two moles of condensed $AlCl_3$. The $AlCl_3$ is not recycled, but is either sold or separately processed in accordance with the dictates of circumstance and economics. Since there is net production of $AlCl_3$, there is not consumption of the only source of chlorine to the process, calcium chloride.

In summary, two of the main chemical features characterizing this invention are: (1) It has been discovered that, at about 1800° C., aluminum monochloride gas is so stable that it will be formed from a mixture containing the chloride of an alkaline earth metal, notably calcium chloride, oxidized aluminum, and a reducing agent such as C, Si, Al, $CaSi_2$, or combinations of these, in spite of the great stability of alkaline earth metal chloride, which makes possible certain processing schemes taking advantage of the fact that aluminum monochloride forms at a temperature below the boiling point of calcium chloride. This constitutes an important distinction from other processes which involve gaseous halogens or halides as reagents. (2) Chlorine can be recycled by reacting aluminum trichloride in aqueous solution with lime to give calcium chloride, the aluminum trichloride having been formed by disproportionation. This wet process step is made possible by the low temperature stability of calcium chloride, especially in the presence of excess lime, and distinguishes from processes using less stable halides; the latter must be implemented dry to avoid losses, corrosion and pollution attendant to formation of HCl gas.

I claim:

1. A process for separating and refining aluminum comprising:

bringing together in a closed process environment a mixture of:

(a) an aluminum-bearing raw material, (b) at least one alkaline earth chloride selected from the group consisting of calcium, barium, strontium and magnesium chlorides, and (c) at least one reducing agent selected from the group consisting of silicon, ferrosilicon, calcium silicide, calcium carbide, silicon carbide, aluminum and carbon;

heating said mixture above 1600° C., during said heating, venting a mixture of gases emitted from the hot mixture into a cooling zone; and collecting condensed chlorides and aluminum from said vented gases.

2. A process according to claim 1, wherein the chloride in said mixture comprises calcium chloride.

3. A process according to claim 1, wherein the condensed chlorides are at least partially recycled into a mixture of said raw materials, chlorides and reducing agents.

4. A process according to claim 3, wherein both condensed aluminum trichloride and calcium chloride are recycled into said mixture.

5. A process according to claim 4, wherein the chloride in said mixture comprises calcium chloride, and further comprising the step of producing said calcium chloride by reacting lime with said recycled aluminum trichlorides in the presence of water.

6. A process according to claim 1, wherein said mixture comprises at its lowest temperature an aluminum bearing clay, metallic aluminum, lime, aluminum trichloride, and said calcium carbonate and aluminum trichloride react at increasing temperature to produce calcium chloride, and said aluminum oxides react in part with the calcium chloride and silicon to produce aluminum chloride.

7. A process for separating and refining of aluminum comprising the steps of heating a mixture of calcium chloride, an aluminum bearing clay selected from the group consisting of kaolin, bauxite and feldspar, and a silicon reducing agent, to a temperature above 1600° C., thereby initiating the reaction of calcium chloride and reducing agent at said higher temperature with aluminum and aluminum oxides to produce aluminum monochloride, and venting said aluminum monochloride into a cooling zone to disproportionate the same into elemental aluminum and aluminum trichloride.

8. A process according to claim 7, including the step of producing said calcium chloride by reacting lime with said recycled aluminum trichloride in the presence of water.

9. A process according to claim 7, wherein said mixture further includes metallic aluminum.

10. A process according to claim 7, including the step of collecting said elemental aluminum, and recycling said aluminum trichloride back into the process.

* * * * *